US007220710B2

(12) United States Patent
Kunz et al.

(10) Patent No.: US 7,220,710 B2
(45) Date of Patent: May 22, 2007

(54) CARBOHYDRATE ESTERS FOR USING AS LUBRICANTS

(75) Inventors: Markwart Kunz, Worms (DE); Jörg Kowalczyk, Eisenberg/Steinborn (DE); Alireza Haji Begli, Ramsen (DE); Rainer Kohlstrung, Schwetzingen (DE); Manfred Harperscheid, Römerberg (DE); Angela Kesseler, Oberhausen (DE); Rolf Luther, Speyer (DE); Theo Mang, Weinheim (DE); Christian Puhl, Grunstadt (DE); Helena Wagner, Köln (DE)

(73) Assignees: Sudzucker Aktiengesellschaft, Mannheim/Ochsenfurt (DE); Fuchs Petrolub AG (DE)

( * ) Notice: Subject to any disclaimer, the term of this patent is extended or adjusted under 35 U.S.C. 154(b) by 502 days.

(21) Appl. No.: 10/486,538

(22) PCT Filed: Jul. 22, 2002

(86) PCT No.: PCT/EP02/08152

§ 371 (c)(1),
(2), (4) Date: Jul. 22, 2004

(87) PCT Pub. No.: WO03/014270

PCT Pub. Date: Feb. 20, 2003

(65) Prior Publication Data

US 2004/0242919 A1 Dec. 2, 2004

(30) Foreign Application Priority Data

Aug. 7, 2001 (DE) ..... 101 38 687

(51) Int. Cl.
*C10M 169/04* (2006.01)
*C07C 53/00* (2006.01)
*C07C 67/02* (2006.01)

(52) U.S. Cl. ..... 508/220; 554/227; 554/228; 560/265

(58) Field of Classification Search ..... None
See application file for complete search history.

(56) References Cited

U.S. PATENT DOCUMENTS

| | | | | |
|---|---|---|---|---|
| 2,380,166 | A | | 7/1945 | Griffin |
| 2,655,451 | A | | 10/1953 | Edgar |
| 3,468,701 | A | | 9/1969 | Hughes |
| 4,297,290 | A | | 10/1981 | Stockburger |
| 4,506,086 | A | * | 3/1985 | Salzburg et al. ..... 549/464 |
| 5,658,863 | A | | 8/1997 | Duncan et al. |
| 5,681,800 | A | | 10/1997 | Duncan et al. |
| 6,013,812 | A | | 1/2000 | Haas et al. |

FOREIGN PATENT DOCUMENTS

| | | |
|---|---|---|
| DE | 42 29 383 | 3/1994 |
| DE | 195 08 938 | 9/1996 |
| EP | 0 380 402 | 8/1990 |
| EP | 0 572 198 | 12/1993 |
| EP | 0 879 872 | 11/1998 |
| GB | 790 472 | 2/1958 |
| WO | WO 81/03293 | 11/1981 |

OTHER PUBLICATIONS

U.S. 5 744 066—English equivalent of DE 19 50 89 38.

* cited by examiner

*Primary Examiner*—Paul A. Zucker
(74) *Attorney, Agent, or Firm*—Ostrolenk, Faber, Gerb & Soffen, LLP

(57) ABSTRACT

The present invention relates to compositions which comprise mixtures of open-chain and cyclic molecules of the sugar alcohols D-sorbitol and D-mannitol which have been esterified with at least one carboxylic acid, processes for preparing these compositions and the use of this composition as lubricant or hydraulic liquid.

58 Claims, No Drawings

CARBOHYDRATE ESTERS FOR USING AS LUBRICANTS

The present invention relates to compositions which comprise mixtures of open-chain and cyclic molecules of the sugar alcohols D-sorbitol and D-mannitol which have been esterified with carboxylic acids, processes for preparing these compositions and the use of this composition as a lubricant or hydraulic oil.

In the Federal Republic of Germany, about 1.15 million metric tons of lubricants are used per year. Of these, about 200 000 metric tons are process oils. The term "lubricants" encompasses generically related products which consist predominantly of mineral oil or are fully or partly synthetic, and are used for lubricating, but also as power train and heat transfer media, dielectrics and process oils. The latter are primarily mineral oil products which are used as assistants in processes in various branches of industry, for example as inert solvents, swelling agents and release agents, for absorbing gases or for binding dust. Within the entire lubricants market, hydraulic liquids have a market volume of about 160 000 metric tons in Germany, about 40% being accounted for by mobile applications and about 60% by stationary applications.

Aging-resistant base oils which are known as base fluids can generally be produced from crude oil distillate fractions and can be adapted to the particular requirements by refining. Many properties of modern lubricant oils are achieved by adding active ingredients, known as additives, without which the modern-day requirements on, for example, engine and gearbox oils could no longer be fulfilled. Lubricants therefore contain on average about 95% of base fluid and about 5% of chemical additives.

Conventional lubricants constitute a considerable burden for the environment. Although about 53% of lubricants in Germany are recovered after use by used oil collection and recycled or are used for energy generation, the rest, i.e. about 540 000 metric tons per year, gets into the environment. Despite relatively reliable storage of these products in tank vessels in gearbox and engine blocks, etc., ways in which lubricants get into the environment include leaks, oil accidents, but also the loss of drops, for example when hydraulic hoses are changed in excavators, and they lead there to contamination, in particular of soils and surface water and groundwater. Further environmental pollution is caused by the consumption, appropriate for the purpose, of certain lubricants in loss lubrication, for example the chain lubrication of mechanical saws. The unavoidable co-combustion of lubricants in engines, and also any form of direct emission, for example by evaporation, constitute a form of environmental pollution. Even when mineral oil products are in principle degradable under favorable growth conditions for the naturally occurring microorganisms, it has nevertheless been found that the natural systems are in practice overburdened by the degradation of mineral oil products.

As a consequence of the high pollution, especially of soils and waters, by lubricants, it is necessary to develop environmentally friendly, in particular biodegradable, oils and lubricants. In the last few years, base fluids for lubricants based on renewable vegetable raw materials, in particular using vegetable oils and their derivatives ("synthetic esters") have therefore been developed. In such synthetic esters, the typical polyol constituents used are branched alcohols such as neopentyl glycol, trimethylolpropane and pentaerythritol (Bongardt, Fat. Sci. Technol., 92 (1990), 473–478) which are converted to saturated esters. Compared to lubricants from mineral oils, such vegetable oils are generally more environmentally friendly and more rapidly biodegradable. However, it has been found that chemically unmodified vegetable oils do not satisfy many technical requirements. The defined chemical, highly specialized modifications of such vegetable oils do sometimes exhibit acceptable performance properties. However, they are very expensive as a consequence of the numerous production steps required for their production. Further disadvantages are that the oxidative, hydrolytic and thermal stability of the vegetable oils are not sufficient for use in circulated lubricant systems, and that high-performance additives for vegetable oils, in particular ecologically nontoxic and environmentally compatible additives, have hitherto only been developed to an insufficient extent.

In contrast, renewable raw materials such as low molecular weight sugars remain substantially unused in the lubricant sector, and their potential as a polyol constituent for synthetic esters is virtually unresearched, even though they have similar functions to the aforementioned alcohols. However, their availability makes the use of these raw materials in the lubricants and hydraulic liquids field very attractive, especially because their natural origin gives rise to great advantages with regard to rapid biodegradability and environmental compatibility.

EP 0 879 872 A1 discloses biodegradable, nontoxic lubricant oil formulations which consist of an ester of a sugar and of a fatty acid. The polyol constituent of the polyester may include a sugar, sugar alcohol or a mixture thereof, and the polyol constituents may be either partly esterified or have a high degree of esterification. The nontoxic lubricant oil formulation described is intended to find use in particular in aggregates which are used in the agricultural and food industry, or in the cosmetics or pharmaceutical industry.

EP 0 572 198 A1 describes lubricant compositions which may likewise be used for machines for producing foods. The compositions comprise a mixture of a first ester of a medium-length saturated fatty acid with glycerol (component A) and of a second ester of a carboxylic acid with sucrose.

DE 42 29 383 C2 describes an edible lubricant with the addition of lubricity-improving esters of fatty acids and higher alcohols. The additives for improving the lubricity consist of at least two esters of edible alcohols having at least two alcohol groups. Useful alcohols include, for example, glycerol, pentaerythritol, arabitol, mannitol and sorbitol.

However, the synthetic esters disclosed in the prior art, which are obtainable on the basis of low molecular weight sugars or sugar derivatives, have some disadvantages, so that they cannot be used on a larger scale as a lubricant base fluid or as a hydraulic fluid. In some cases, they do not have the properties required for use in this field, such as viscosity-temperature behavior, viscosity-pressure behavior, aging and oxidation stability, hydrolysis stability, compressibility, elastomer compatibility, compatibility with the materials used in corresponding aggregates, foaming behavior, air release capability, cold properties, coefficient of friction, wear protection in a four-ball apparatus to DIN 58524, etc. Their production is in some cases also too expensive which, as a result of their specific applications, can be attributed to the use of special starting materials. In addition, some of these synthetic esters can be degraded fully and without residue by natural systems only with difficulty, if at all.

The technical problem on which the present invention is based is thus to provide new types of synthetic ester whose structure is based fully on renewable raw materials and which are obtainable in particular using low molecular weight sugars and fatty acids which can be isolated from vegetable sources as base fluids for lubricants and hydraulic fluids, and processes for their production, the synthetic esters on the one hand having the required performance properties such as oxidation stability, thermal stability and viscosity-cold behavior, and, on the other hand, as a consequence of their natural origin, being rapidly biodegradable without residue and thus environmentally compatible to a high degree, and additionally being producible in an inexpensive manner.

The present invention solves this technical problem by providing a composition comprising a mixture of D-sorbitol, D-mannitol and cyclic derivatives of these sugar alcohols, these constituents having been esterified with at least one carboxylic acid, which is suitable for use as a base fluid for lubricants or hydraulic liquids. In other words, the present invention provides a mixture of esterified open-chain and cyclic D-sorbitol and D-mannitol molecules, which may be used in the lubricants field.

The sugar alcohols D-sorbitol and D-mannitol have several advantages over other sugars or sugar alcohols, which predestine them as a starting material for the preparation of n-alkyl esters. For instance, both sugar alcohols have very good hydrolytic and thermal stability. D-Sorbitol and D-mannitol may be prepared on the industrial scale easily and extremely inexpensively from renewable vegetable starting materials. D-Sorbitol may be prepared, for example, by catalytic hydrogenation from glucose, hydrolyzed starch or hydrolyzed sucrose. The use of sucrose as a starting material, in which case an acidic hydrolysis is carried out to form invert sugar, leads after hydrogenation not only to sorbitol, but also to D-mannitol.

Fatty acid esters of sorbitol and sorbitan, the partly dehydrated form of sorbitol, already find widespread use as emulsifiers or stabilizers. They are neither poisonous nor aggressive (Maag, J. Am. Oil Chem. Soc., 61 (1984), 259–267; Khan, Adv. Carbohyd. Chem. Biochem., 33 (1976), 235–294). Mono-, di- and triesters of sorbitan, known as "Spans", together with their ethoxylated derivatives, known as "Tweens", already have a secure place in foods, pharmaceuticals and numerous industrial applications (Kosswig, in: Ullmanns Enzykl. Techn. Chem., publisher: Bartholomew et al., 4th edition, Volume 22 (1982) 455–515, Verlag Chemie, Weinheim). As a consequence of their structure and synthesis and the resulting properties, the esters of D-sorbitol and D-mannitol are also very suitable for use in the lubricants field, in particular as a base fluid.

Partially dehydrated derivatives of the two sugar alcohols D-sorbitol and D-mannitol are suitable to an exceptional degree as starting components for the ester synthesis, since they have outstanding chemical, thermal and hydrolytic stability properties. The intramolecular dehydration of the sugar alcohols leads to cyclic compounds which may be used as polyols for the preparation of esters. Intramolecular dehydration of the two sugar alcohols in particular allows the degree of branching of the polyol esters to be controlled and thus also their property potential to be influenced, for example the viscosity behavior which is decisive for use as a lubricant or hydraulic liquid. The stereochemistry of the compounds also plays a decisive role here.

Investigations of the applicant of the present invention have shown that, surprisingly, the esterification of mixtures which comprise D-sorbitol and its dehydrated derivatives monoanhydrosorbitol and dianhydrosorbitol, and also D-mannitol and its dehydrated derivatives monoanhydromannitol and dianhydromannitol, i.e. the esterification of mixtures which comprise open-chain and cyclic molecules of D-sorbitol and D-mannitol, with carboxylic acids, in particular fatty acids from renewable raw materials, leads to fully or virtually fully esterified n-alkyl ester product mixtures. The resulting product mixtures which comprise fully esterified open-chain and cyclic molecules of the two sugar alcohols have outstanding lubricant and hydraulic fluid properties, for example viscosity-temperature behavior which is outstandingly suitable for this field of application, very good cold flow performance and very good cold stability, very good wear behavior, i.e. load-bearing capability, very good resistance toward oxidative aging, very good foaming behavior, very good air release capability and an advantageous viscosity position. It has been found that, surprisingly, the properties of the resulting product mixture firstly depend upon the structure of the individual open-chain and cyclic products and that secondly, synergisms occur within the product mixture and are to be regarded as extremely positive, especially with regard to the properties required for use as a lubricant, such as viscosity-cold properties and oxidation stability.

In connection with the present invention, the term "suitable for use as a lubricant" means that a substance or substance mixture can reduce the friction and stress of machine parts moving against each other or on each other. Such substances thus reduce the energy consumption and material wear and also function as coolants. "Suitable for use as a hydraulic fluid" means that a substance or substance mixture has properties which enable use of the substance or substance mixture as an energy transfer fluid in hydrostatic or hydrokinetic (hydrodynamic) systems. According to the invention, "for use as a lubricant or as a hydraulic fluid" means in particular that those substances or substance mixtures are suitable for use as a base liquid for lubricants or hydraulic oils and does not rule out the addition of further conventionally used additives for lubricants or hydraulic oils, such as phenolic and/or aminic antioxidants, phosphorus/sulfur extreme pressure/antiwear additives, corrosion inhibitors, foam inhibitors and the like.

A preferred embodiment of the invention therefore relates to a composition comprising a mixture of D-sorbitol, D-mannitol and cyclic derivatives thereof, these constituents having been esterified with at least one carboxylic acid, as a base fluid for lubricants or as a base fluid for hydraulic oils, wherein the composition additionally comprises lubricant-typical or hydraulic oil-typical additives selected from the group consisting of phenolic and/or aminic antioxidants, phosphorus/sulfur extreme pressure/antiwear additives, corrosion inhibitors and foam inhibitors.

A particularly preferred embodiment of the invention relates to a composition which, in addition to esterified open-chain molecules of D-sorbitol and D-mannitol, also comprises esterified cyclic D-sorbitol and D-mannitol derivatives, the cyclic derivatives of the two sugar alcohols being in particular mono- and dianhydrohexitols.

The investigations of the inventors of the present invention have also shown that compositions which comprise fully or virtually fully esterified open-chain and cyclic D-sorbitol and D-mannitol molecules have particularly advantageous properties for the lubricants field. In contrast, compositions in which the free hydroxyl groups of the polyol constituents used have only been partially esterified with carboxylic acids additionally have an emulsifying action. However, such an emulsifying action leads to undesired effects in technical uses of the product mixture, for example foam formation.

The present invention therefore provides that, in the inventive compositions which comprise open-chain and cyclic D-sorbitol and D-mannitol molecules which have been esterified with at least one carboxylic acid, at least two of the free available hydroxyl groups in each individual molecule have been esterified with a carboxylic acid. In connection with the present invention, the term "esterified with at least one carboxylic acid" means that the free hydroxyl groups of an individual polyol molecule, irrespective of whether it is an open-chain or a cyclic molecule of D-sorbitol or D-mannitol, may have been esterified with different carboxylic acid radicals. Particular preference is given in accordance with the invention to a composition in which all or virtually all free hydroxyl groups in each individual D-sorbitol or D-mannitol molecule have been esterified with a carboxylic acid. The inventive composition which comprises a mixture of open-chain and cyclic molecules of the sugar alcohols D-sorbitol and D-mannitol is therefore preferably fully esterified with at least one carboxylic acid, since the composition thus-has properties which are of essential importance for use of the composition as a base fluid for lubricants or hydraulic liquids.

The invention provides in particular that the cyclic and open-chain D-sorbitol and D-mannitol molecules used in accordance with the invention have been esterified with aliphatic alkanecarboxylic acids and/or derivatives thereof. One embodiment of the invention therefore relates to a composition in which the acid constituent of the polyol mixture according to the invention is an unsaturated or saturated, branched or unbranched carboxylic acid or a derivative thereof or a mixture thereof. According to the invention, this may be a monocarboxylic acid, a dicarboxylic acid, a tricarboxylic acid, a derivative thereof or a mixture thereof. For the adjustment of the viscosity, the reaction may in particular be with di- and tricarboxylic acids which are esterified again in a further step with fatty alcohols, in order thus to maintain the low acid numbers, i.e. the carboxylic acid derivative is an ester of a di- or tricarboxylic acid with a fatty alcohol. According to the invention, the polyol constituents of the inventive composition are esterified using in particular fatty acids which may be obtained from renewable indigenous vegetable raw materials, and also their technical-grade fatty acid cuts. Fatty acids obtained from indigenous renewable raw materials are used as the alkyl constituent of the inventive composition in particular with a view to the protection of resources and the biodegradability of the esterified polyol products.

A preferred embodiment of the invention relates to a composition in which the open-chain and cyclic D-sorbitol and D-mannitol molecules have been esterified with monocarboxylic acids. The chain length of the alkyl constituent has a significant influence on the properties of the resulting esterified product, for example the high-temperature and viscosity-cold behavior. The invention therefore provides that the polyol constituents of the inventive composition have preferably been esterified with $C_2$–$C_{24}$-monocarboxylic acids, more preferably with $C_6$–$C_{18}$-monocarboxylic acids.

A particularly preferred embodiment of the invention relates to a composition in which the open-chain and cyclic D-sorbitol and D-mannitol molecules have been esterified with acetic acid, butyric acid, isobutanoic acid, valeric acid, isovaleric acid, caproic acid, enanthic acid, caprylic acid, 2-ethylcaproic acid, pelargonic acid, capric acid, lauric acid, myristic acid, myristoleic acid, palmitic acid, palmitoleic acid, stearic acid, oleic acid, elaidic acid, ricinoleic acid, linoleic acid, linolenic acid, eleostearic acid, arachic acid, behenic acid or erucic acid, or mixtures thereof. They are preferably naturally occurring vegetable fatty acids.

In a further preferred embodiment of the invention, the open-chain and cyclic D-sorbitol and D-mannitol molecules have been esterified with dicarboxylic acids, in particular $C_2$–$C_{24}$-dicarboxylic acids, preferably $C_4$–$C_{18}$-dicarboxylic acids. In a preferred embodiment, these are oxalic acid, malonic acid, succinic acid, glutaric acid, adipic acid, pimelic acid, maleic acid, fumaric acid or sorbic acid.

In a further preferred embodiment of the invention, the open-chain and cyclic sugar alcohol molecules have been esterified with tricarboxylic acids, for example citric acid.

The present invention also provides that derivatives of the carboxylic acids, such as anhydrides, mixed anhydrides, alkyl esters and in particular carbonyl chlorides, may be used to esterify the derivatives. The anhydrides are the products of an acid, for example of a carboxylic acid, which are obtainable, for example, by dehydration. The loss of water from two different acids may provide mixed anhydrides. Alkyl esters may be prepared by a reaction of carboxylic acids with alcohols which is catalyzed by acids such as sulfuric acid etc. A further preferred embodiment of the invention therefore relates to compositions in which the open-chain and cyclic D-sorbitol and D-mannitol molecules have been esterified with carboxylic acid derivatives, for example anhydrides, mixed anhydrides, alkyl esters and/or in particular carbonyl chlorides.

In a further preferred embodiment, the sugar alcohol molecules may also be esterified with isomers of carboxylic acids such as cis/trans isomers within the structure or at geometric positions. The isomers are compounds having the same empirical, but different structural, formulae. Cis/trans isomers are stereoisomers which feature a different atom arrangement in three-dimensional space, in particular a different arrangement of the substituents. Stereoisomers thus differ in the configuration and/or the conformation.

The present invention provides that the proportion of the esterified open-chain and cyclic D-sorbitol derivatives in the overall composition is in particular from 95% to 5% and the proportion of the esterified open-chain and cyclic D-mannitol derivatives is correspondingly from 5% to 95%. The proportion of the esterified D-sorbitol derivatives in the overall composition is preferably from 92% to 50% and the proportion of the esterified D-mannitol derivatives is from 8% to 50%. The proportion of the esterified D-sorbitol derivatives in the overall composition is more preferably from 90% to 70% and the proportion of the esterified D-mannitol derivatives from 10% to 30%.

A further preferred embodiment of the present invention relates to an inventive composition which comprises a mixture of open-chain and cyclic D-sorbitol and D-mannitol molecules which have been esterified with at least one carboxylic acid, and additionally at least one further open-chain and/or cyclic carbohydrate, polyol, a derivative thereof or a mixture thereof, each of which has been esterified with at least one carboxylic acid, a derivative thereof or a mixture thereof. The addition of further esterified carbohydrates and/or polyols allows the performance properties of the inventive composition to be adapted in accordance with the particular specific requirements and modified, in particular with regard to the viscosity-temperature behavior, viscosity-pressure behavior, aging and oxidation stability, hydrolysis stability, compressibility, elastomer compatibility, compatibility with the materials used in corresponding aggregates, foaming behavior, air release capability, cold properties, coefficient of friction, wear protection in a four-ball apparatus to DIN 58524, etc.

A preferred embodiment of the invention provides that the carbohydrate and/or polyol is selected from the group consisting of a monosaccharide such as glucose, fructose, mannose, arabinose, xylose, sorbose and galactose, a disaccharide such as sucrose, maltose, trehalose, lactose, isomaltulose and trehalulose, a trisaccharide such as raffinose, a sugar alcohol such as erythritol, xylitol, sorbitol, mannitol, maltitol, lactitol, arabitol, 6-O-α-D-glucopyranosyl-D-sorbitol (1,6-GPS), 1-O-α-D-gluco-pyranosyl-D-sorbitol (1,1-GPS) and 1-O-α-D-glucopyranosyl-D-mannitol (1,1-GPM), starch hydrolyzates, fructooligo-saccharides, hydrogenated products thereof or a mixture thereof such as isomalt as a mixture of 1,6-GPS and 1,1-GPM.

According to the invention, the esterified open-chain and cyclic derivatives of the further carbohydrates or polyols have been esterified with the same carboxylic acids as the D-sorbitol and D-mannitol derivatives. They have therefore preferably been esterified with aliphatic n-alkanecarboxylic acids and/or derivatives thereof, i.e. with unsaturated or saturated, branched or unbranched carboxylic acids or derivatives thereof or a mixture thereof. In a preferred embodiment, the further carbohydrate and/or polyol derivatives have been esterified with monocarboxylic acids, dicarboxylic acids, tricarboxylic acids, derivatives thereof or a mixture thereof. For the adjustment of the viscosity, the reaction may in particular be with a di- and tricarboxylic acid which are esterified again in a further step with fatty alcohols, in order thus to maintain the low acid numbers. In other words, an ester of a di- or tricarboxylic acid with a fatty alcohol can be used for the reaction. According to the invention, these further constituents of the inventive composition are esterified using in particular fatty acids which may be obtained from renewable indigenous vegetable raw materials, and also their technical-grade fatty acid cuts.

The invention provides in particular that the proportion of the further esterified carbohydrate and/or sugar alcohol derivatives in the overall composition is from 0.5% to 50%, preferably from 1 to 40%.

The present invention also relates to a process for preparing a composition which comprises a mixture of open-chain and cyclic molecules of the sugar alcohols D-sorbitol and D-mannitol which have been esterified with at least one carboxylic acid, comprising a) cyclizing the sugar alcohols by dehydration to obtain a mixture of monoanhydrohexitols, dianhydrohexitols and open-chain sugar alcohol molecules, and
b) partially or fully esterifying the hexitols which have been dehydrated to different degrees with at least one carboxylic acid, at least one derivative thereof or a mixture thereof, or
c) cyclizing and partially or fully esterifying as a one-pot reaction.

The cyclization of D-sorbitol is disclosed in the prior art. For instance, Lewis (Surfactant Sci. Ser., 72 (1998), 219–223) has shown, by isolating and characterizing the products, that D-sorbitol can be converted by dehydration to a substituted furan ring, 1,4-sorbitan or monoanhydro-sorbitol (MAS), and, with repeated elimination of water, to a bicyclic structure, isosorbitol or 1,4:3,6-dianhydrosorbitol (DAS). More recent investigations have shown that, in addition to the 1,4-sorbitan form, other sorbitan isomers, for example 3,6-sorbitan, 2,5-sorbitan and 5,2-sorbitan, can also be formed (Bock et al., Acta Chem. Scand., 35 (1981), 441). In the case of 1,4- or 3,6-sorbitan, a further dehydration may be effected, giving in both cases 1,4:3,6-dianhydrosorbitol. In the case of the 2,5- and 5,2-sorbitan isomers, repeated elimination of water is not possible. The 1,4-sorbitan isomer can readily be isolated as a crystallizable solid, whereas the 3,6-isomer is difficult to detect. Selection of suitable reaction conditions may allow only partial cyclization of D-sorbitol to be achieved, so that a mixture is obtained which comprises substantially the noncyclized D-sorbitol form, i.e. the open-chain form, monoanhydrosorbitol and dianhydrosorbitol. In a similar manner, D-mannitol may also be converted to monoanhydro-mannitol (MAM) and dianhydromannitol (DAM) (Reiff, in: Ullmanns Enzyk. Techn. Chem., publisher: Bartholomew et al., 4th edition, volume 24 (1983), 772–777, Verlag Chemie Weinheim).

Starting from the sugar alcohols D-sorbitol and D-mannitol in respective desired proportions, a mixture of open-chain sugar alcohol molecules, i.e. D-sorbitol and D-mannitol, and cyclic sugar alcohol molecules, i.e. anhydro- and dianhydrohexitols, is initially prepared in the first stage, preferably in the presence of a catalyst.

Subsequently, in the second stage, for example with the same catalyst or with a second catalyst, using suitable reagents, the esterification or transesterification of this mixture is carried out with saturated or unsaturated, branched or unbranched carboxylic acids, derivatives thereof or mixtures thereof. According to the invention, monocarboxylic acids, dicarboxylic acids, tricarboxylic acids, derivatives thereof or a mixture thereof may be used for the esterification.

Particular preference is given in accordance with the invention to using $C_2$–$C_{24}$-monocarboxylic acids such as acetic acid, butyric acid, isobutyric acid, valeric acid, isovaleric acid, caproic acid, enanthic acid, caprylic acid, 2-ethylcaproic acid, pelargonic acid, capric acid, lauric acid, myristic acid, myristoleic acid, palmitic acid, palmitoleic acid, stearic acid, oleic acid, elaidic acid ricinoleic acid, linoleic acid, linolenic acid, eleostearic acid, arachic acid, behenic acid or erucic acid.

In a further preferred embodiment of the invention, carboxylic acid derivatives such as anhydrides, mixed anhydrides, alkyl esters, in particular carbonyl chlorides, or isomers such as cis/trans isomers within the structure or at a geometric position may also be used for the esterification.

The present invention provides in particular that this esterification or transesterification is carried out in such a way that at least two hydroxyl groups in each open-chain or cyclic sugar alcohol molecule are esterified. Particular preference is given in accordance with the invention to all free hydroxyl groups of each open-chain and cyclic sugar alcohol molecule being esterified. The degree of esterification of the molecules may be controlled by selecting suitable reaction conditions.

The desired esterified products may be prepared both batchwise and continuously, i.e. cyclization and esterification of the sugar alcohols may be carried out either continuously or batchwise. Both reaction steps may proceed in known organic solvents such as toluene, DMSO, pyridine, DMF, etc., or else without solvent in the presence of one or more suitable catalysts.

According to the invention, useful catalysts or catalyst mixtures are in particular transition metal compounds of Sn, Ti, Zn/Cu, etc., in particular salts, oxides, alkyls, etc., mineral acids such as HCl, $H_2SO_4$ and $H_3PO_4$, organic acids such as p-toluenesulfonic acid, methanesulfonic acid and sulfosuccinic acid, and also acidic ion exchangers, alkali metal salts such as sodium or potassium hydroxide, sodium or potassium carbonate, sodium or potassium ethoxide, sodium or potassium methoxide, zeolites or a mixture thereof. According to the invention, preference is given in particular to the combination of p-toluenesulfonic acid as the catalyst for the cyclization reactor and a tin oxalate catalyst, for example Tegokat 160® from Goldschmidt, as the esterification catalyst. This catalyst combination is found to be extremely effective with regard to the synthesis of the desired products. The acceptable color of the products obtained in this way was particularly advantageous, so that no, or only few, further purification steps have to be carried out. When caprylic anhydride is used as the esterification reagent, this inventively preferred catalyst combination leads to virtually complete conversion. When this catalyst combination is used, complete esterification using caprylic acid as the esterification reagent is also possible. A further inventively preferred catalyst combination comprises p-toluenesulfonic acid as the catalyst for cyclizing and dibutyltin oxide as the catalyst for esterifying.

A preferred embodiment of the invention provides that the cyclization reaction is carried out at a temperature of from 80° C. to 190° C., more preferably from 100° C. to 170° C. The esterification reaction takes place in particular at a temperature of from 120° C. to 280° C., preferably at a temperature of from 160° C. to 250° C.

The present invention provides in particular that water formed during the reaction is continuously removed during both steps, in particular during the cyclization of the sugar alcohols. The water resulting from the reaction has an unfavorable effect in particular on the position of the equilibrium in the subsequent esterification and is therefore preferably removed. For example, the water formed in the cyclization may be removed as vapor with the aid of a nitrogen stream passed through the flask toward the end of the reaction. The present invention thus provides that water forms during the cyclization and/or esterification is preferably removed by means of rectification or azeotropic rectification.

In summary, the inventively preferred reaction conditions for the cyclization comprise the following parameters: the use of a stirred reactor, in which case nitrogen may or may not be passed through the reactor, the removal of the water formed in the reaction by distillation, in particular by means of rectification and azeotropic rectification, carrying out the cyclization in a solvent, but more preferably without solvent, preferably at a temperature of from 70° C. to 180° C., more preferably at from 100° C. to 160° C., a reaction time of from 0.2 to 6 hours, preferably from 0.5 to 3 hours, and carrying out the reaction in the presence of a catalyst, the amount of the catalyst used based on the sugar starting materials being from 0.05 to 10% by weight, preferably 0.1–5% by weight.

In summary, the inventively preferred reaction conditions for the esterification in the case of batchwise operation comprise the following parameters: use of a stirred reactor, in which case the esterification may also be carried out in accordance with the invention in from two to five stages in a stirred tank battery, removing water during the reaction by rectification/distillation or azeotropic rectification, carrying out the reaction in an organic solvent, for example toluene, DMF or ether, or without solvent, a reaction time of from 2 to 36 hours, preferably from 8 to 26 hours, and carrying out the esterification in the presence of a catalyst, the amount of catalyst, based on the total amount, being 0.05–10% by weight, preferably 0.1–5% by weight. The starting substances, polyol and acid, are present, based on the monomer units, preferably in a ratio of from 1:1 to 1:10, more preferably in a ratio of from 1:1.5 to 1:7. According to the invention, the esterification in batchwise operation is carried out under a reduced pressure of from 1013 to 5 mbar, preferably from 300 to 10 mbar.

The inventively preferred reaction conditions for the esterification in continuous operating mode comprise the use of a bubble-cap tray column having sections for the rectification/distillation and also for the reaction, and the countercurrent principle may be used in accordance with the invention. In this case, the sugar alcohol solution (preferably a from 30% to 90% aqueous solution) is introduced continuously to an upper tray, or a solution of an already cyclized polyol or a mixture of the aforementioned components and/or a solution of an already partly esterified polyol. As in the batchwise operating mode, an amount of catalyst, based on the overall composition of from 0.05 to 10% by weight, preferably from 0.1 to 5% by weight, is used. In the case of homogeneous catalysts, they are introduced continuously to the uppermost tray or mixed into the reactant stream. Solid catalysts are distributed on the bubble-cap trays. The acid components or mixtures thereof are introduced as superheated vapor to the lowermost tray. The product is removed in the bottom of the column, while the water is removed at the top of the column. Entrained acid components are recycled into the column from a phase separator. The temperatures for carrying out the esterification in the continuous operating mode are preferably from 120° C. to 280° C., preferably from 160° C. to 250° C. The reaction or residence times are from 1 to 24 hours, preferably from 4 to 10 hours. According to the invention, the ratio of polyol to acid components is from 1:1 to 1:10, preferably from 1:1.5 to 1:7. In a preferred embodiment of the invention, the prereaction up to homogenization proceeds in a stirred tank and subsequently the virtually complete esterification in the column.

The present invention also relates to the use of the inventive compositions which comprise a mixture of open-chain and cyclic derivatives of D-sorbitol and D-mannitol which have been esterified with at least one carboxylic acid, at least one derivative thereof or a mixture thereof, and the compositions may optionally also comprise further esterified open-chain and/or cyclic carbohydrate or polyol derivatives or mixtures thereof, each of which have likewise been esterified with at least one carboxylic acid, at least one derivative thereof or a mixture thereof. The present invention provides that these compositions which may be prepared by a process according to the invention may be used as lubricants and functional liquids, in particular as a fluid for lubricating internal combustion engines, mechanical power trains such as gearboxes in motor vehicles and stationary applications, gas compressors, refrigeration machines, turbines and chain devices such as chainsaws, as an oil for lubricating moving parts in industrial machines and moldings and molds in the production of moldings, as a universal oil for tractors and other mobile working machines, as a lubricating grease, as a shock absorber fluid, as a fluid for hydraulic power trains and drives, the hardening of metallic materials, the reshaping of metal without cutting, the submersed processing of metal with cutting and the processing of metal with cutting with minimum lubrication, as a corrosion protection fluid, as an oil for insulating electrical components such as transformers and as a heat transfer oil.

The invention is illustrated in detail by the examples which follow.

EXAMPLE 1

Cyclization of D-sorbitol

The suitable reaction conditions for the cyclization of D-sorbitol to the main products, monoanhydrosorbitol (MAS) and dianhydrosorbitol (DAS), were determined in numerous preliminary experiments. It was evident from these preliminary experiments that, for example, the use of a solvent could be dispensed with. It was also found that reaction temperatures above 140° C. or reaction times of more than two hours led to products whose color was too intensive, so that they could not be used after esterification as a base fluid for lubricants.

The dehydration took place directly in the D-sorbitol melt, so that the use of a solvent could be dispensed with. The dependence of the composition of the product mixture upon the duration of the dehydration was investigated with the aid of progress samples which were analyzed by gas chromatography. As a consequence of its disruptive influence on the subsequent esterification, the water released as steam in the dehydration was removed with the aid of a nitrogen stream passed through the flask toward the end of the reaction. While the content of dianhydrosorbitol (DAS) during the reaction only increased slowly, the sorbitan content rose substantially more rapidly. The slow increase in the amount of DAS was in agreement with the fact that it was formed in a reaction subsequent to the dehydration of D-sorbitol to MAS. The maximum of the MAS or DAS concentration had not been attained even after two hours, i.e. there was still some D-sorbitol which had yet to be cyclized.

The cyclizations preceding the esterifications were carried out at 140° C. and a reaction time of 1 hour 45 minutes, since suitable product mixtures were obtained within this period. The main product after the end of the cyclization was the monoanhydride in a proportion of from 56 to 74%, followed by undehydrated D-sorbitol (from 37 to 12%) and dianhydrosorbitol (from 2 to 6%).

EXAMPLE 2

Cyclization of an Equimolar D-Sorbitol/D-Mannitol Mixture

The cyclization of an equimolar D-sorbitol/D-mannitol mixture was carried out in a similar manner to the dehydration of D-sorbitol. As a consequence of the higher melting point of D-mannitol of 168° C. (melting point of D-sorbitol from 110° C. to 112° C.), the water elimination had to be carried out at higher temperature. Only at 155° C. did D-mannitol fully dissolve in the D-sorbitol melt and was cyclized by adding 0.3% of p-toluenesulfonic acid (p-TSA), based on the hexitol mass, and the reaction time was restricted to 75 minutes. In this way, the coloring of the reaction mixture resulting from the thermal stress could be kept relatively low. In a similar manner to the dehydration of D-sorbitol, water formed was removed from the reaction mixture.

It could be concluded from the progress of the cyclization of an equimolar D-sorbitol/D-mannitol mixture using p-TSA that the elimination of water in the case of D-mannitol proceeds distinctly more slowly than in the case of D-sorbitol. While the maximum of monodehydrated D-sorbitol had been attained after only 90 minutes after a rapid increase in the content of sorbitan, the concentration of monoanhydromannitol (MAM) was still rising. After 2 hours, the concentration of MAS had slightly decreased in favor of the fully dehydrated DAS forming subsequently. The content of DAS likewise increased more rapidly than that of dianhydromannitol (DAM).

EXAMPLE 3

Batchwise Cyclization of D-Sorbitol/D-Mannitol and Esterification with Caprylic Acid (Variant I)

In a stirred reactor, 250 g of a 1:1 mixture of D-sorbitol and D-mannitol were dehydrated at 155° C. for 1.25 hours in the presence of 0.8 g of p-toluenesulfonic acid. After 1.05 kg of caprylic acid and 6 g of tin oxalate had been added, the mixture was stirred at 195° C. for 10 hours, in the course of which water was removed by distillation. On completion of reaction and removal of the catalyst, the excess acid was removed under reduced pressure. The product obtained was a clear bright yellow oil.

EXAMPLE 4

Batchwise Cyclization of D-Sorbitol/D-Mannitol and Esterification with Caprylic Acid (Variant II)

In a stirred tank, 500 g of a 1:1 mixture of D-sorbitol and D-mannitol were dehydrated at 155° C. for 1.25 hours in the presence of 1.6 g of p-toluenesulfonic acid. After a mixture of 1.95 kg of caprylic acid and 0.2 kg of acetic acid, and also 11.5 g of tin oxalate, had been added, the mixture was stirred at 190° C. for 8 hours, in the course of which water was removed by distillation. On completion of reaction and removal of the catalyst, excess acid was removed under reduced pressure. The product obtained was a clear almost colorless oil.

EXAMPLE 5

Continuous Cyclization of D-Sorbitol/D-Mannitol and Esterification with Capric Acid The reaction was carried out in a bubble-cap tray column (11 actual trays, static holdup =200 ml/tray, internal diameter of the trays =80 mm, height =100 mm/tray). At the third tray from the top, 1.4 mol/h of a 1:1 mixture of D-sorbitol and D-mannitol as a 60% (% by weight) aqueous solution were introduced. Trays 2 to 12 were each charged with 200 ml of highly temperature-stable acidic ion exchange resin. In addition, three kg/h of capric acid (9.1 mol/h) were introduced as superheated vapor to the lowermost tray. The column was operated at 195° C. A capric acid/water mixture was removed via the top of the column. After cooling and phase separation, water was removed, while capric acid was fed back into the top of the column. 3.1 kg/h of capric acid-containing sugar ester were obtained from the cold bottom of the column. Excess acid was removed under reduced pressure and the product was isolated as an almost colorless oil.

EXAMPLE 6

Use of a Composition Comprising a Mixture of Esterified Open-Chain and Cyclized D-Sorbitol/D-Mannitol Derivatives (MMDDSM Esters)

The ester mixture obtained in the preceding examples 3 to 5 (MMDDSM), comprising monoanhydrosorbitol, monoanhydro-mannitol, dianhydrosorbitol, dianhydromannitol, D-sorbitol and D-mannitol, all derivatives having been fully esterified with caprylic acid or capric acid, were tested for their suitability as a base fluid for hydraulic oils. The MMDDSM ester mixture was additized with typical additives for hydraulic oils, such as phenolic and aminic antioxidants, phosphorus/sulfur extreme pressure/antiwear additives, corrosion inhibitors and a foam inhibitor. The resulting composition had the following properties:

Kinematic viscosity at 40° C.: 44 $mm^2/s$. The kinematic viscosity is to be regarded as advantageous, since the surprisingly determined value corresponds to the ISO VG 46 viscosity class which is most commonly used.

Pour point: −48° C. The measurement was in accordance with DIN ISO 3016. The pour point value determined is to be regarded as very good.

Long-term cold stability: The base fluid was still free-flowing after 3 days at −25° C. The value is to be regarded as good.

Air release capability at 50° C.: 1 minute. The air release capability was measured to DIN 51381 and is to be regarded as very good.

Demulsification capability: 15 minutes at 50° C. The measurement was in accordance with DIN 51599. The value is to be regarded as good.

Load-bearing capability/wear behavior: Still free of damage at load stage (12) in the FZG A/8.3/90 test method. The wear scar diameter is 0.30 mm in a four-ball apparatus according to DIN 51350. The values are to be regarded as very good.

Aging stability: 2100 hours in the turbine oil stability test without the addition of water until an acid number of 2 mg KOH/g had been attained. This measurement is to be regarded as very good, since at least 2000 hours are the aim for a hydraulic oil of the highest quality based on esters.

COMPARATIVE EXAMPLE 1

For comparison, a base fluid based on glycerol which had been fully esterified with a mixture of caprylic acid and capric acid was compared. This base fluid was additized with phenolic and aminic antioxidants, phosphorus/sulfur extreme pressure/antiwear additives, corrosion inhibitors and a foam inhibitor, and the additives used were identical to those in example 6. For this base fluid, the following properties were determined as a hydraulic liquid:

Kinematic viscosity at 40° C.: 15 $mm^2s$. For most applications, the value determined is to be regarded as too low.

Pour point: −10° C. The measurement was likewise in accordance with DIN ISO 3016. For most applications, especially in colder climates, this value is to be regarded as not low enough.

Long-term cold stability: After three days at −25° C., no longer free-flowing. In cold climates, this determined value is unacceptable.

Air release capability at 50° C.: 6 minutes. The measurement was then in accordance with DIN 51381. This value is to be regarded as moderately good.

Demulsification capability: 20 minutes at 50° C. The measurement was in accordance with DIN 51599. The value is to be regarded as good.

Load-bearing capability/wear behavior: In the FZG A/8.3/90 test method, load stage 10 was found to be still free of damage. The wear scar diameter was 0.35 mm in a four-ball apparatus to DIN 51350. These values are to be regarded as moderately good.

Aging stability: 1200 hours in the turbine oil stability test without the addition of water until an acid of number 2 mg KOH/g had been attained. This value is to be regarded as moderately good.

COMPARATIVE EXAMPLE 2

In this example, the base fluid used was glycerol which had been fully esterified with sunflower oil fatty acid (high oleic quality, oleic acid fraction 80%). The additives used were phenolic and aminic oxidants, phosphorus/sulfur extreme pressure/antiwear additives, corrosion inhibitors and a foam inhibitor, and the additives were identical to those in example 6. For this base fluid, the following properties were determined:

Kinematic viscosity at 40° C.: 38 $mm^2/s$

Pour point: −10° C. The measurement was in accordance with DIN ISO 3016. This value is not low enough for most applications, especially in colder climates.

Long-term cold stability: After three days at −25° C., no longer free-flowing. This value is unacceptable in cold climates.

Air release capability at 50° C.: 4 minutes. The measurement was in accordance with DIN 51381. The value is to be regarded as good.

Demulsification capability: 22 minutes at 50° C. The measurement was in accordance with DIN 51599. The value is to be regarded as good.

Load-bearing capability/wear behavior: Load stage (12) without damage in the FZG A/8.3/90 test method. The wear scar diameter in the four-ball apparatus to DIN 51350 was 0.31 mm. The values are to be regarded as very good.

Aging stability: 450 hours in the turbine oil stability test without the addition of water until an acid number of 2 mg KOH/g had been attained. This value is to be regarded as poor.

In summary, the values for the inventive MMDDSM ester mixture and the two comparative base fluids can be assessed as follows. The inventive MMDDSM ester mixture exhibits very good cold flow performance and very good cold stability, very good wear behavior, i.e. load-bearing capability, very good resistance toward oxidative aging, very good air release capability and an advantageous viscosity position.

Compared to the inventive MMDDSM esters, comparative example 1 exhibits a viscosity position which is useful only for few uses, distinctly poorer flow performance at low temperatures, poor load-bearing capability and moderate resistance toward oxidative aging. Compared to the inventive MMDDSM ester, comparative example 2 exhibits distinctly poorer flow performance at relatively low temperatures and poor resistance toward oxidative aging.

What is claimed is:

1. A composition comprising a mixture of D-sorbitol and its dehydrated derivatives monoanhydrosorbitol and dianhydrosorbitol, and also of D-mannitol and its dehydrated derivatives monoanhydromannitol and dianhydromannitol, these constituents having been esterified with at least one carboxylic acid, wherein the composition has viscosity-temperature behavior, load-bearing capability, cold stability and resistance toward oxidative aging which are suitable for use as a lubricant or hydraulic liquid.

2. The composition of claim 1, wherein the carboxylic acid is selected from the group consisting of a saturated carboxylic acid, unsaturated carboxylic acid, branched carboxylic acid, unbranched carboxylic acid, a derivative thereof and a mixture thereof.

3. The composition of claim 2, wherein the carboxylic acid is a monocarboxylic acid, dicarboxylic acid, tricarboxylic acid, a derivative thereof or a mixture thereof.

4. The composition of claim 2, wherein the monocarboxylic acid is a $C_2$–$C_{24}$-carboxylic acid.

5. The composition of claim 2, wherein the monocarboxylic acid is a $C_4$-$C_{18}$-carboxylic acid.

6. The composition of claim 2, wherein the monocarboxylic acid is acetic acid, butyric acid, isobutanoic acid, valeric acid, isovaleric acid, caproic acid, enanthic acid, caprylic acid, 2-ethylcaproic acid, pelargonic acid, capric acid, lauric acid, myristic acid, myristoleic acid, palmitic acid, palmitoleic acid, stearic acid, oleic acid, elaidic acid, rhizoleic acid, linoleic acid, linolenic acid, eleostearic acid, arachic acid, behenic acid or erucic acid.

7. The composition of claim 2, wherein the derivative of the carboxylic acid is an anhydride, mixed anhydride, an alkyl ester or a carbonyl chloride.

8. The composition of claim 7, wherein the derivative of the carboxylic acid is an ester of a di- or tricarboxylic acid with a fatty alcohol.

9. The composition of claim 2, wherein the derivative of the carboxylic acid is an isomer within the structure or at a geometric position.

10. The composition of claim 1, wherein at least two hydroxyl groups of D-sorbitol, D-mannitol and the cyclic derivatives thereof are esterified.

11. The composition of claim 10, wherein all free hydroxyl groups of D-sorbitol, D-mannitol and the cyclic derivatives thereof are esterified.

12. The composition of claim 1, wherein the proportion of the esterified D-sorbitol derivatives in the overall composition is from 95% to 5% and the proportion of the esterified D-mannitol derivatives in the overall composition is from 5% to 95%.

13. The composition of claim 12, wherein the proportion of the esterified D-sorbitol derivatives in the overall composition is from 92% to 50% and the proportion of the esterified D-mannitol derivatives in the overall composition is from 8 to 50%.

14. The composition of claim 12, wherein the composition of the esterified D-sorbitol derivatives in the overall composition is from 90% to 70% and the proportion of the D-mannitol derivatives in the overall composition is from 10 to 30%.

15. The composition of claim 1, wherein the mixture comprising D-sorbitol, D-mannitol and cyclic derivatives thereof, these constituents having been esterified with at least one carboxylic acid, additionally comprises at least one further carbohydrate, polyol, a derivative thereof or a mixture thereof, each of which has been esterified with at least one carboxylic acid, a carboxylic acid derivative or a mixture thereof.

16. The composition of claim 15, wherein the at least one of carbohydrate and polyol is selected from the group consisting of a monosaccharide, a disaccharide a trisaccharide and a sugar alcohol.

17. The composition of claim 15, wherein the proportion of the further esterified carbohydrate and/or polyol constituents in the overall composition is from 0.5% to 50%.

18. The composition of claim 17, wherein the proportion of the further esterified carbohydrate and/or polyol constituents in the overall composition is from 5 to 30%.

19. A process for preparing a composition which comprises a mixture of D-sorbitol, D-mannitol and cyclic derivatives thereof, these constituents having been esterified with at least one carboxylic acid, comprising the steps of:

a) cyclizing D-sorbitol and D-mannitol by dehydration to obtain a mixture of D-sorbitol, D-mannitol, monoanhydrohexitols and dianhydrohexitols, and b) partially or fully esterifying the hexitols which have been dehydrated to differing degrees with at least one carboxylic acid, at least one derivative thereof or a mixture thereof, or c) carrying out the process as a one-pot reaction with at least one catalyst.

20. The process of claim 19, wherein the carboxylic acid used for the esterification is selected from the group consisting of a saturated carboxylic acid, unsaturated carboxylic acid, branched carboxylic acid, unbranched carboxylic acid, a derivative thereof and a mixture thereof.

21. The process of claim 19, wherein the carboxylic acid used for the esterification is a monocarboxylic acid, dicarboxylic acid, tricarboxylic acid, a derivative thereof or a mixture thereof.

22. The process of claim 19, wherein the carboxylic acid is a $C_2$–$C_{24}$ -monocarboxylic acid.

23. The process of claim 19, wherein esterification is effected using a carboxylic acid derivative within the structure or at a geometric position.

24. The process of claim 23, wherein esterification is effected using a di- or tricarboxylic acid which has been esterified with a fatty alcohol.

25. The process of claim 19, wherein the steps are carried out batchwise or continuously.

26. The process of claim 19, wherein the two steps are carried out in a solvent or without solvent, in the presence of a suitable catalyst.

27. The process of claim 26, wherein an organic solvent is used.

28. The process of claim 26, wherein the catalyst used is a transition metal compound, a mineral acid, an organic acid, an acidic ion exchanger, an alkali metal salt, a zeolite or a mixture thereof.

29. The process of claim 28, wherein the catalyst used for cyclizing is p-toluenesulfonic acid and the catalyst used for esterifying is a tin oxalate catalyst or dibutyltin oxide.

30. The process of claim 19, wherein the cyclization is carried out at a temperature of from 80° C. to 190° C.

31. The process of claim 30, wherein the cyclization is carried out at a temperature of from 100° C. to 170° C.

32. The process of claim 19, wherein the esterification is carried out at a temperature of from 120° C. to 280° C.

33. The process of claim 32, wherein the esterification is carried out at a temperature of from 160° C. to 250° C.

34. The process of claim 19, wherein water is removed during both steps by rectification or azeotropic rectification.

35. A method of lubricating moving mechanical parts comprising adding to said parts the composition of claim 1.

36. The method of claim 35, wherein said parts are present in an item selected from the group consisting of combustion engine, mechanical power train, gearbox in a motor vehicle, gas compressor, refrigeration machine, turbine and chain device.

37. A method of making a molding comprising applying the composition of claim 1 as a lubricant in a mold comprised of moving parts and forming the molding in the mold.

38. A method of making a shock absorber comprising adding the composition of claim 1 in said shock absorber as shock absorber fluid.

39. A method of preventing metal corrosion comprising applying to said metal the composition of claim 1.

40. A method of insulating electrical components comprising applying to said components the composition of claim 1.

41. The method of claim 40, wherein said components are electrical transformers.

42. A method of transferring heat from a first location to a second location comprising adding the composition of claim 1 between said two locations.

43. The composition of claim 9, wherein the isomer is a cis/trans isomer.

44. The composition of claim 16, wherein the monosaccharide is glucose, fructose, mannose, arabinose, xylose, sorbose or galactose.

45. The composition of claim 16, wherein the disaccharide is sucrose, trehalose, maltose, lactose, isomaltulose or trehalulose.

46. The composition of claim 16, wherein the trissacharide is raffinose.

47. The composition of claim 16, wherein the sugar alcohol is erythritol, xylitol, sorbitol, mannitol, maltitol, lactitol, arabitol, 6-O-α-D-glucopyranosyl-D-sorbitol (1,6-GPS), 1-O-α-D-glucopyranosyl-D-sorbitol (1,1-GPS) or 1-O-α-D-glucopyranosyl-D-mannitol (1,1-GPM), starch hydrolyzates, fructooligosaccharides, hydrogenated products thereof or a mixture thereof.

48. the composition of claim 44, wherein the mixture is isomalt as a mixture of 1,6-GPS and 1,1-GPM.

49. The process of claim 22, wherein the $C_2$–$C_4$ monocarboxylic acid is acetic acid, butyric acid, isobutanoic acid, valeric acid, isovaleric acid, caproic acid, enanthic acid, caprylic acid, 2-ethylcaproic acid, pelargonic acid, capric acid, lauric acid, myristic acid, myristoleic acid, palmitic acid, palmitoleic acid, stearic acid, oleic acid, elaidic acid, rhizoleic acid, linoleic acid, linolenic acid, eleostearic acid, arachic acid, behenic acid or erucic acid.

50. The process of claim 23, wherein the carboxylic acid derivative is an anhydride, mixed anhydride, or an alkyl ester.

51. The process of claim 50, wherein the carboxylic acid derivative is a carbonyl chloride.

52. The process of claim 50, wherein the carboxylic acid derivative is an isomer within the structure or at a geometric position.

53. The process of claim 52, wherein the isomer is a cis/trans-isomer.

54. The process of claim 27, wherein the organic solvent is toluene, DMSO, pyridine or DMF.

55. The process of claim 28, wherein the transition metal compound is a salt, oxide or alkyl of Sn, Ti or Zn/Cu.

56. The process of claim 28, wherein the mineral acid is HCl, $H_2SO_4$ or $H_3PO_4$.

57. The process of claim 28, wherein the organic acid is p-toluenesulfonic acid, methanesulfonic acid or sulfosuccinic acid.

58. The process of claim 28, wherein the alkali metal salt is a hydroxide, carbonate, methoxide or ethoxide of sodium or potassium.

* * * * *